US005195281A

United States Patent [19]

Kosko

[11] Patent Number: 5,195,281

[45] Date of Patent: Mar. 23, 1993

[54] DECK TROUGH

[76] Inventor: John J. Kosko, 20609 Hazelnut Ct., Germantown, Md. 20874

[21] Appl. No.: 892,321

[22] Filed: Jun. 2, 1992

[51] Int. Cl.[5] ..... E04D 13/00

[52] U.S. Cl. ..... 52/11; 52/22; 52/95; 52/481

[58] Field of Search ..... 52/11, 289, 702, 404, 52/169.5, 169.14, 209, 303, 302, 533, 22 X, 95 X, 481 X, 15

[56] References Cited

U.S. PATENT DOCUMENTS

| | | | |
|---|---|---|---|
| 135,044 | 1/1873 | Morden | 52/481 |
| 195,593 | 9/1877 | Evans | 52/407 |
| 612,024 | 11/1898 | Drake | 52/22 |
| 709,257 | 9/1902 | Cottrell | 52/404 |
| 3,417,519 | 12/1968 | Hitter | 52/11 |
| 4,102,092 | 7/1978 | Ward | 52/95 |
| 4,655,018 | 4/1987 | Pardo | 52/302 |
| 4,860,502 | 8/1989 | Mickelson | 52/11 |
| 5,074,093 | 12/1991 | Meadows | 52/533 |

*Primary Examiner*—Carl D. Friedman
*Assistant Examiner*—Wynn E. Wood

[57] ABSTRACT

A trough-like device can be integrally built into the floor-joist structure of a typical wooden deck to render the deck a water-proof roof over area below which can then be enclosed to obtain a room, a garage, or other such dry storage area.

5 Claims, 4 Drawing Sheets

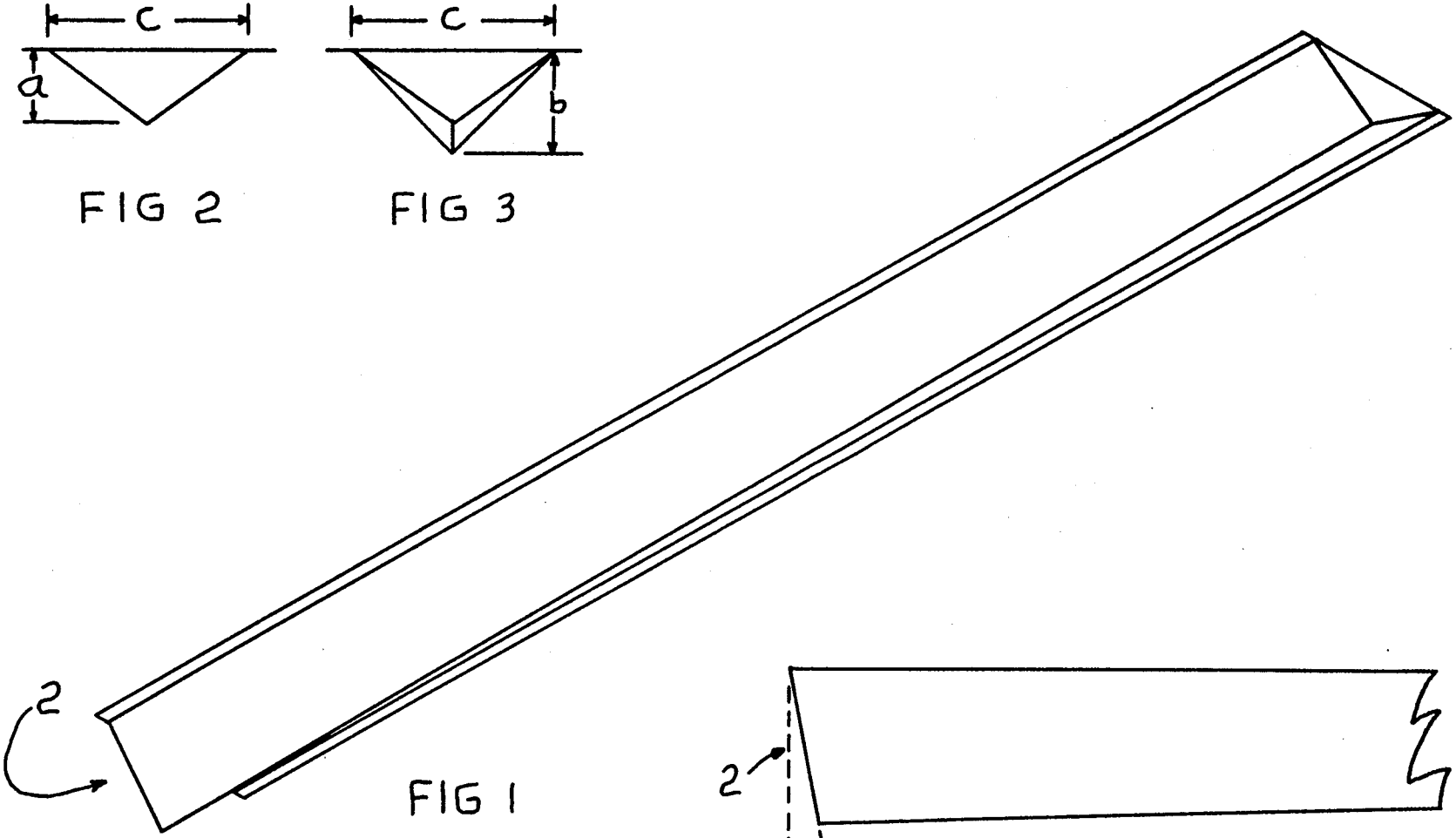
FIG 1
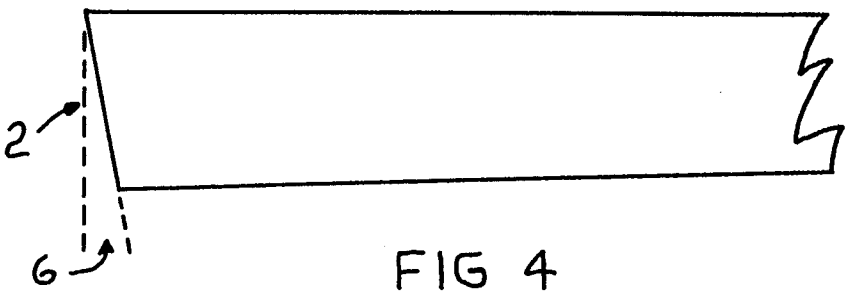
FIG 4
FIG 3
FIG 2

DECK TROUGH

BACKGROUND OF THE INVENTION a. Field of the Invention

The invention relates generally to a device that can facilitate the integration of a water catching, channelling, and expelling feature into a joist structure so as to render resultant structure a water-proof roof over area below.

b. Description of prior art

Wooden decks, such as those that are typically attached to a house or other such structure, are generally comprised of flooring planks arranged in a side-by-side manner and fastened to a supporting joist structure which is in turn supported by a post-beam structure or a wall. (Such decks may or may not include attached safety barriers, but such barriers are not pertinent to the problem being addressed.) A typical non-roofed weather-exposed wooden deck does not function as a water-proof roof since water can seep through the cracks between the flooring planks and subsequently fall onto and through the supporting joist structure to the area below. Yet, a water-proof roof feature can be a significant attribute of a deck, especially in instances where it is desirable to enclose the area below the deck to achieve a dry storage area which can serve as a garage, a room, or a storage shed. The problem, therefore, is to build a deck that also functions as a water-proof roof.

One method of achieving such a deck is to cover the deck joist structure with plywood and in turn cover the plywood with a modified asphalt roofing membrane material (such as NORD or GAFGLASS) which is either glued onto or torch-down-attached to the plywood. Spacer boards (e.g., 2"×4" boards) are then generally placed on top of the subject water-proofed surface, and flooring planks are then nailed onto the spacer boards. While such an approach does not achieve the desired roofing characteristic, the reliability and longevity of the water-proofing material used in such a configuration is questionable. Consequently, the spacer/plank flooring is sometimes built in sections that can be more easily removed to enable servicing, repair, or replacement of the water-proofing material. While such a design achieves the desired roofing feature, it has several drawbacks. The plywood, water-proofing material, and sectionalization of the flooring add significant costs. Also, the joist-plywood surface must be pitched to facilitate water run-off. Finally, any servicing, repair, or replacement of the water-proofing material requires removal of the spacer/plank flooring—a potentially expensive proposition, especially if the water-proofing material requires relatively frequent servicing, repair, or replacement.

Another, more straightforward, approach for achieving the desired water-proof roof characteristic is to simply build a conventional sloped roof (i.e., joists, plywood or particle board, tarpaper) topped with shingles, or sheet tin or aluminum, or even the membrane material mentioned above, and then construct a conventional deck over top separate from the roof. However, such an approach requires even more materials, is more expensive, "steals" significant vertical clearance space (because two joist structures are required) and incurs servicing/repair problems similar to the previously described approach because roof access is limited by the presence of the "overhead" deck. While such an approach doesn't really achieve an integral "roof-deck" structure, it does provide the immediate functionality desired and is mentioned herein only for the sake of attempting to provide a more thorough assessment of prior art.

Finally, some decks, or probably more appropriately porches, are simply constructed of concrete wherein a concrete slab is supported by a joist structure. Such an endeavor requires molds and is quite expensive. While it is feasible to achieve a water-proof roofing feature with such a structure, expense alone is probably a prohibitive drawback in most cases.

In light of the above, clearly what is needed is a means for constructing or enabling the construction of a deck that 1) incorporates the desired water-proof roof feature, 2) does not rely on a pitched joist structure to achieve water run-off, 3) either minimizes the maintenance access problem or provides a highly reliable roof function that does not require significant maintenance, and 4) is either cheaper than (or at least economically competitive with) alternative means for constructing a deck with a water-proof feature.

The Deck Trough, the invention being applied for herewith, provides an economical means to integrate a highly reliable water-proof roof feature into a joist structure such as that integral to a typical wooden deck. A wooden deck comprising such a joist structure facilitates the construction of a room, garage, shed or other such dry-area structure below said deck, wherein said joist structure serves as the integral roof for the below dry-area structure. Additionally, such a deck retains virtually all of the other features typical of a conventionally built deck.

The invention, therefore, indirectly enables the construction of a dry-area structure such as a garage, room, or shed, that utilizes a wooden deck as its roof. Further, such a deck: provides a highly-reliable water-proof roof function, does not rely on a pitched joist structure to achieve water run-off, and is economically competitive with, if not necessarily cheaper than, alternative means for constructing a deck having said water-proof roof feature.

SUMMARY OF THE INVENTION

The invention relates to a device that provides a means to integrate a water catching, channelling, and expelling feature into a joist structure wherein said joist structure can thus serve as a roof over any structure built below, and wherein said joist structure can also support an above-mounted flooring structure such at that formed by the planks of a wooden deck floor.

The invention comprises a lipped trough-like device which further comprises an outlet for water to escape. A number of such devices can be installed in a joist structure so as to cover and otherwise fit in-between all of the joists and serve to catch, channel, and expel water falling or seeping into the resultant joist-device structure from an above-mounted flooring structure. The device, as fabricated from alluvium flashing or vinyl and as properly integrated into an overall deck structure with supplemental flashing and gasketing, adds a highly reliable water-proof roof feature to the deck at a cost estimated to be less than that of alternative approaches. Since the device is installed so as to exploit the space between joists, incorporation of the said feature does not consume any appreciable amount of what is typically otherwise unused space.

It is an object of the invention to provide an economical means for adding a reliable water-proof roof feature to a joist structure such as that of a typical wooden deck so as to enable said deck to serve as an integral roof over a structure below.

BRIEF DESCRIPTION OF THE DRAWINGS

FIG. 1 shows an embodiment of a single end-wall V-shaped Deck Trough.

FIG. 2 shows an end-view of the shallow/enclosed end of the single end-wall Deck Trough with the balance of the Trough cutaway.

FIG. 3 is an end-view of the deep/open end of the single end-wall Deck Trough.

FIG. 4 is a side view of the deep/open end section of the single end-wall Deck Trough.

DESCRIPTION OF THE PREFERRED EMBODIMENT

Figure 5:
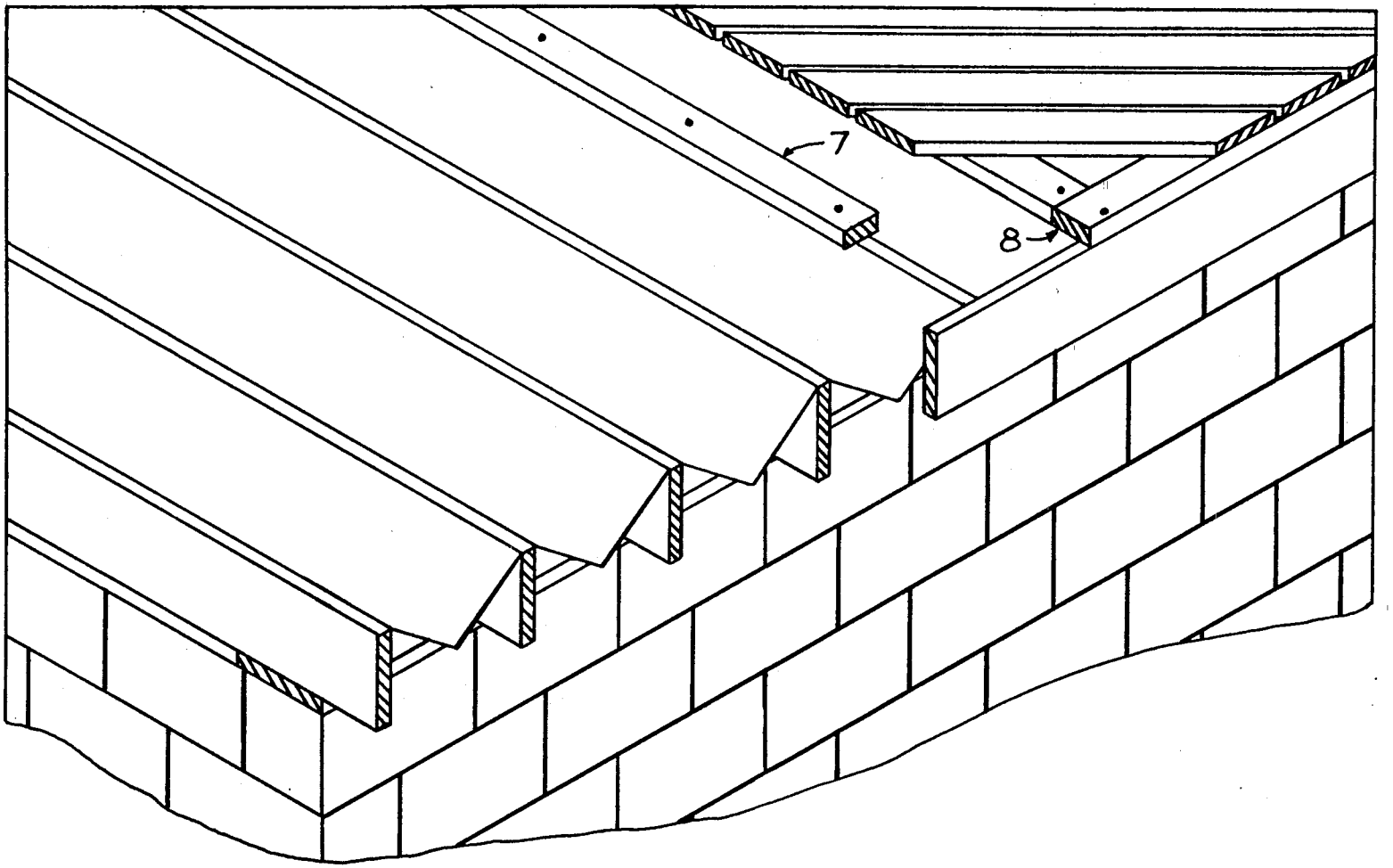
FIG. 5 is a cut-away view of single end-wall Deck Troughs implemented in a wooden deck that cantilevers past the end of a support wall that also serves as an integral part of an underlying dry-storage area.

The preferred embodiment of the invention is comprised of a lipped trough-like device preferably V-shaped and preferably fabricated from a thin sheet of aluminum (such as aluminum flashing) which is relatively cheap and which has an expected life span of from 30 to 60 years. While aluminum is probably the best material, molded vinyl would probably work well, and other materials such as fiberglass, or some other type of plastic material, or some other type of malleable non-rusting metal might also work well. A V-shaped Trough as represented by FIG. 1 is preferred because a V-shape requires the least amount of material for a given trough depth and therefore, is likely to be cheaper to manufacture than say a box-shaped or a basin-shaped trough. However, a box-shaped or basin-shaped trough that is lipped, pitched, and sized to hang from and otherwise fit between the joists could perform the same function. Regardless of the exact shape, the design innovation here is that the device exploits what is normally "dead" or unused space between the joists to provide the water catching, channeling and expelling feature, and to thereby, as supplemented by appropriate flashing and gasketing, enable the integration of an economical and highly reliable roof feature into a joist structure without detracting from the ability of the joist structure to support an above-mounted floor and otherwise serve as a typical deck.

The FIG. 1 embodiment of a V-shaped Deck Trough comprises a shallow/ enclosed end (1) and a deep/open end (2). The bottom (3) of the Trough is pitched with respect to the lips (4 and 5) so that, with the Trough installed to hang via the lips from adjacent level joists, water entering the Trough will flow to the deep/open end (2) and out of the outlet (6). The Trough outlet (6) is formed by the lack of a deep-end wall plus a cut-out of the trough walls in that area, angled from the Trough top to the Trough bottom so as to render the length of the Trough bottom somewhat shorter than the length of Trough top as illustrated in FIG. 4. (The cut-out facilitates water escape in installations wherein the deep/-wall-less end of the Trough abuts up to a joist end member such as in the FIG. 5 installation.) Trough length, as measured longitudinally along the Trough top, is typically approximately equal to the joist lengths. Trough width (less the lips) is less than, but approximately equal to, the distance between joists. The Trough lips extend far enough from the Trough main body so as to cover the majority of the joist tops.

Dimensions (a) and (b) as shown in FIG. 2 and FIG. 3 are indicative of Trough depth. Dimension (a) is the depth at the shallow end, and dimension (b) is the depth at the deep end. Dimension (a) is typically 25% to 50% of the joist top-to-bottom height. Dimension (b) is typically 75% of the joist top-to-bottom height. Dimension (b) is greater than dimension (a) so as to yield a pitch to cause water to flow to and out of the outlet located at the deep end of a Trough installed level to ground. Dimension (c) is the Trough width, exclusive of the lips, and is less than, but approximately equal to, the distance between joists.

FIG. 5 illustrates a number of the devices (i.e., FIG. 1 embodiment devices) installed in a cantilevered joist structure design wherein an enclosed dry-structure resides below. The devices are hung from the joist tops via said lips so as to reside mainly in-between the joists and otherwise cover the below area, exclusive of the cantilevered area where water is expelled from the devices. Since one device is needed for each joist space, the total number of devices required equals the total number of joists used less one. The lips of adjacent devices overlap so as to completely cover all the joist tops. A gasketing material is placed between the lips to insure water-tight integrity. Spacer boards (7 and 8) comprising 2"×4" timbers are then screwed onto and along the longitude of the joists and also onto and along the longitude of the end members to which the joists are attached. To insure water-tight integrity, rubber washers are placed between the spacer boards and the device lips at the points where the spacer board attachment screws penetrate the device lips. The spacer boards installed on the joist longitudes provide two important functions. First, the boards serve as a substrate for the flooring planks which are fastened to the spacer boards with nails (or screws) that are shorter than the combined thickness of a spacer board thickness plus plank thickness. Second, the joist-top spacer boards serve as an "umbrella" over the joist top. Water falling or seeping through from an above mounted deck floor either falls or seeps onto a spacer board or falls directly into the device. Water falling into the device is caught, channelled, and subsequently expelled through the device outlet. Water falling or seeping onto a spacer board falls or seeps over the side of the board and onto the device. Water that may seep around and under a spacer board, while expected to be minimal if any at all, is prevented from getting through the joist structure by the gasketing and rubber washers. While water is expelled directly onto the ground in this design, additional guttering to provide further routing of the expelled water could readily be implemented if desired.

Figure 6:
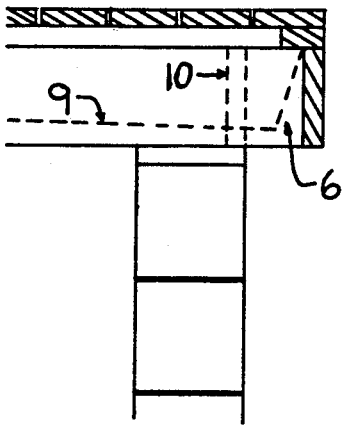
FIG. 6 is a side view of the support-wall end section of the structure shown in FIG. 5.
Figure 7:
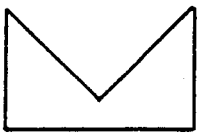
FIG. 7 shows the filler board used in the FIG. 5 structure.

FIG. 6 provides a cross-sectional view of the support-wall end of the structure shown in FIG. 5. Installed Deck Trough (9), as hidden behind the joist, is represented by dashed lines with escape outlet (6) similarly represented. End filler board (10), also hidden behind joist, fills in the area between the Trough and the board on the top of the support wall so as to shield the inside of structure below the deck from the outside elements. A weatherizing caulk or weather insulating tape is installed between the device/filler-board abutment to attain an enhanced degree of weatherization. FIG. 7 shows a front view of said filler board.

Figure 8:
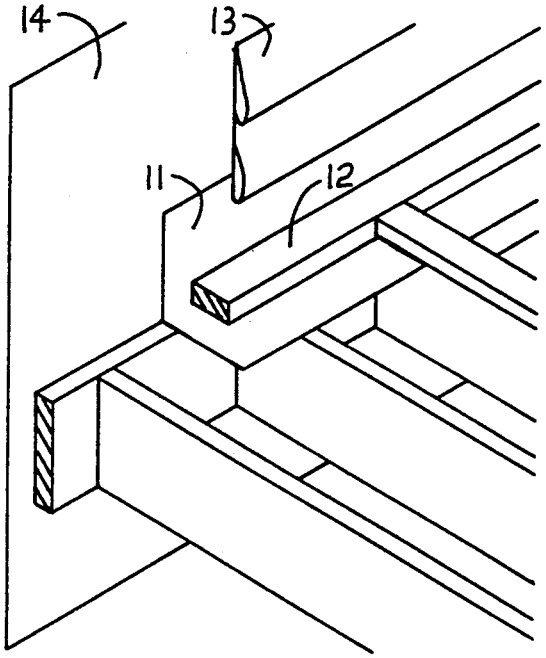
FIG. 8 is a cut-off view of a portion of the deck that is attached to a house wall.

Achieving water-proof integrity where the deck end opposite the support-wall end abuts against a structure such as a house depends in part on the nature of the house wall and on the type of house siding prevalent. However, FIG. 8 illustrates the salient points for doing so on an aluminum-sided frame house (the Deck Troughs and flooring planks are omitted in FIG. 8 for clarity). Basically, a piece of aluminum flashing (11) the length of the abutment and bent to form a 90-degree angle along the longitude is positioned under the spacer (12) that covers the joist end member and also up and under the aluminum siding (13) on the house wall (14). Rubber washers and gasketing are used as previously described. Operationally, water that runs down the side of the house or otherwise falls onto the deck near subject deck-house abutment is routed out over the joists by the flashing where the water subsequently ends up in the Deck Troughs (not shown) as previously described above. The same basic approach can be used even for a brick house wherein some mortar would be removed from a row of brick, the flashing inserted, and then the mortar or some other filler/ sealing compound can be re-installed. Similar flashing techniques can be used around the periphery of the deck so as to render the entire deck a water-proof roof.

Figure 9:
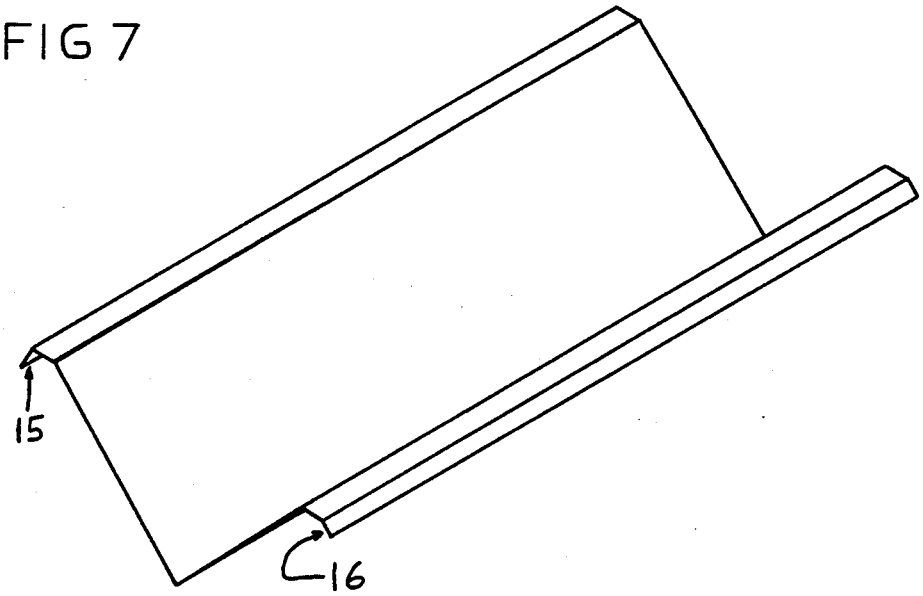
FIG. 9 is a cut-out middle section of an extended-lip Deck Trough.
Figure 10:
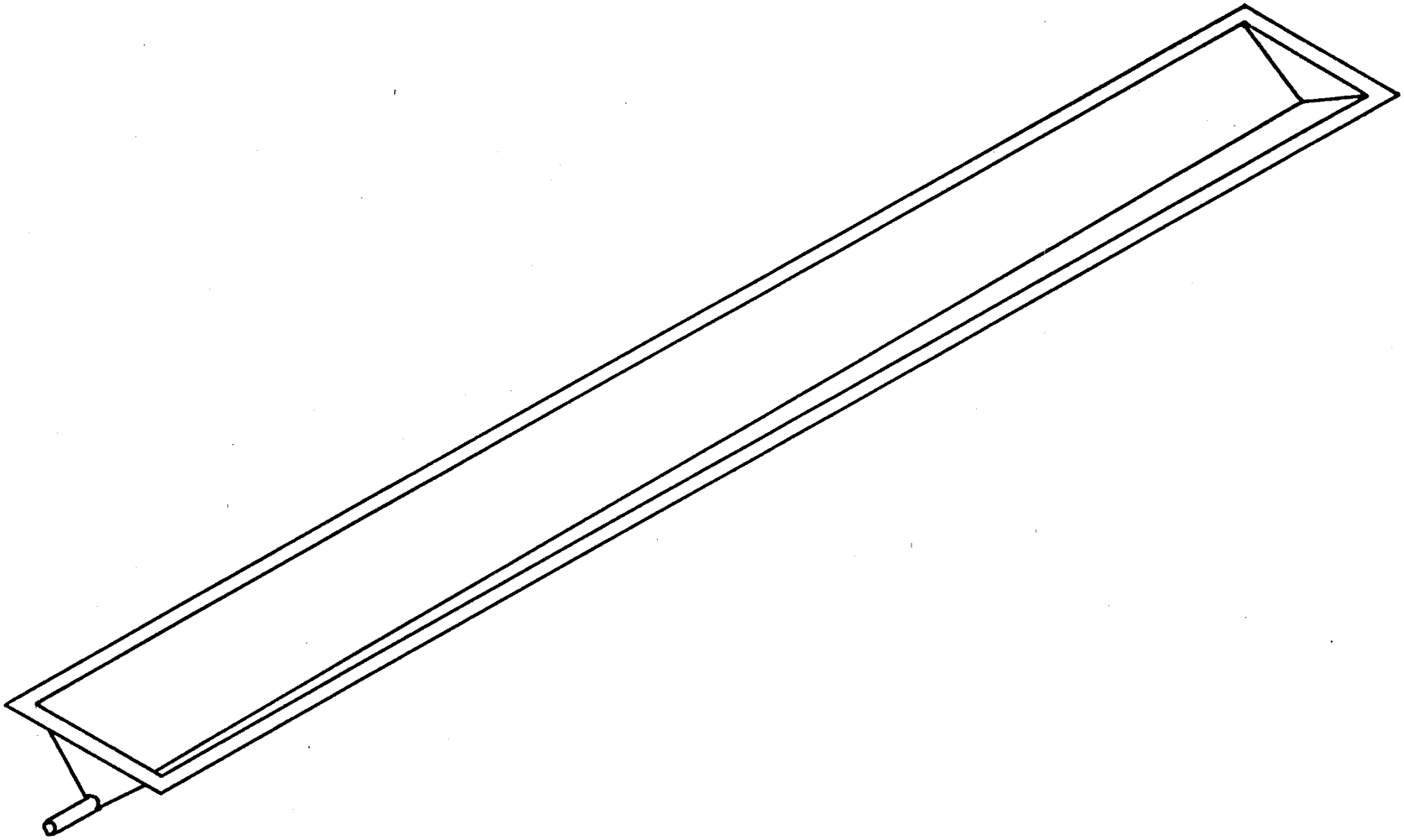
FIG. 10 shows a double end-wall Deck Trough with a pipe outlet.

While the FIG. 1 embodiment and the FIG. 5 installation demonstrate the concept, other Deck Trough embodiments are contemplated. For example, FIG. 9 shows a mid-section portion of an extended-lip Deck Trough. The extended-lips (15 and 16) serve to provide complete overlaps of Deck Troughs integrally installed in a joist structure so as to provide added protection against water infiltration at the joist tops and thereby eliminate the need for gasketing. While the single end-wall Deck Troughs illustrated in FIG. 1 and FIG. 9 are readily constructed from aluminum flashing and work well for cantilevered installations, the double end-wall Deck Trough shown in FIG. 10 is more amenable to vinyl fabrication and is not operationally reliant upon cantilevering to achieve the desired water expelling effect. In the FIG. 10 is more amenable to vinyl fabrication and is not operationally reliant upon cantilevering to achieve the desired water expelling effect. In the FIG. 10 embodiment, the basic lips in the FIG. 1 design are extended to form a continuous lip around the entire periphery of the Trough, but of greater significance is the outlet design which is comprised of an integrally formed pipe shape which extends out from the low point of the deep end wall. An advantage of this embodiment is that the pipe outlet could be inserted through a hole in the joist end member so that cantilevering of the joist structure would not be required. As with the FIG. 1 embodiment, the FIG. 10 embodiment also exploits the space between joists to catch, channel, and expel water from the joist structure and thereby enable construction of a deck having an embedded water-proof roof feature. Similar double end-wall Trough embodiments that expel water into a drainage piping within a structure below the joists also are contemplated.

While the illustrated embodiments have been discussed in terms of a new-construction deck, it is noted that the FIG. 9 embodiment is also amenable to a retrofit application since the embodiment could be attached to the bottoms of the joist structures in existing wooden decks. In such a retrofit application, watertight integrity at the joist bottoms can be maintained by using rubber washers between the Troughs and the joists at the points where Trough lip penetrations are made by securing screws. While such a retrofit application would not provide all the features of the integral design, it could, never-the-less, render most of the area under an existing deck a drip-proof area, which in itself might be a desirable feature to add to an existing deck in certain instances.

While the embodiments discussed above portray a Deck Trough for application between two adjacent joists, a multiple Deck Trough comprising two or more single-space Troughs (i.e., FIG. 1 Troughs) ganged together to provide said water catching, channelling, expelling feature for multiple, adjacent joist spaces also is contemplated. And, while only one detailed embodiment of the invention is illustrated in the drawings and described in detail, this invention contemplates any basic lipped/pitched-depth trough-like receiver embodiment that can serve to exploit the space between deck floor joists so as to provide a water catching/guttering means which enables the construction of a wooden deck that has the added feature of serving as a water-proof roof over area below the deck.

I claim:

1. A device was installed between the floor support joists of a wooden deck, said device comprising a watertight, trough-like receiver sized to fit between and extend along the entire length of adjacent floor joists thereby covering the area between and below said joists, said device having means to collect and channel water entering said area, said receiver further comprising integral lips covering the top surfaces of adjacent joists, said lips providing means for attaching said receiver to and suspending said receiver between said joists, said receiver having a pitched depth from a shallow end to a deep end, said receiver further comprising an outlet in said deep end providing means of water to escape.

2. The device as claimed in claim 1 having a depth which does not extend below said joists and whereby said device does not extend above said joists beyond the thickness of said lips.

3. The device as claimed in claim 2 further comprising extended lips that entirely overlap the top surfaces of said joists and extend partially down the outside walls of said joists thereby forming a complete watertight cap over said joists.

4. The device as claimed in claim 2, said device constructed of a single piece of aluminum flashing formed into a V-shaped receiver comprising two sidewalls extending along the length of said joists, said device further comprising an end wall connecting said sidewalls at the shallow end of the receiver, said device having an open end at the deep end of the receiver serving as said water outlet.

5. The device as claimed in claim 2, said device constructed of vinyl formed into a V-shaped receiver comprising two sidewalls extending along the length of said joists, said device further comprising an end wall connecting said sidewalls at the shallow end of said receiver and an end wall connecting said sidewalls at the deep end of said receiver, said device having a pipe outlet extending out from said deep end wall, and integral lips extending around the entire periphery of said device.

* * * * *